US005850675A

United States Patent [19]

Bourquin et al.

[11] Patent Number: 5,850,675

[45] Date of Patent: Dec. 22, 1998

[54] DEVICE FOR DETACHABLY FIXING A WATCHBAND TO A WATCH CASE

[76] Inventors: Francis Bourquin, Chemin des Lorettes 12, 2520 La Neuveville; Louis Wiser, Rue du Paddock 114, 2854 Bassecourt, both of Switzerland

[21] Appl. No.: 820,673

[22] Filed: Mar. 18, 1997

[30] Foreign Application Priority Data

Mar. 18, 1996 [CH] Switzerland ..... 00709/96

[51] Int. Cl.[6] ..... A44C 5/00

[52] U.S. Cl. ..... 24/265 WS; 24/71 J; 24/265 B

[58] Field of Search ..... 24/265 WS, 265 B, 24/71 J

[56] References Cited

U.S. PATENT DOCUMENTS

| | | | |
|---|---|---|---|
| 1,202,271 | 10/1916 | Depollier | 24/265 WS |
| 1,202,272 | 10/1916 | Depollier | 24/265 WS |
| 1,226,316 | 5/1917 | Depollier | 24/265 B |
| 2,009,484 | 7/1935 | Dinhofer | 24/265 WS |
| 2,185,736 | 1/1940 | Prestinari | 24/265 |
| 2,510,938 | 6/1950 | Boots | 24/265 WS |
| 2,980,976 | 4/1961 | Coulter | 24/265 B |
| 4,716,631 | 1/1988 | Gay | 24/265 B |

FOREIGN PATENT DOCUMENTS

| | | |
|---|---|---|
| 92 03 248 | 8/1992 | Germany . |
| 349 221 | 11/1960 | Switzerland . |

*Primary Examiner*—Victor N. Sakran
*Attorney, Agent, or Firm*—Bacon & Thomas

[57] ABSTRACT

A watchband securing device includes a variable length rod extending between opposed watch case horns. One of the horns is pivotally connected to the watch case and one end of the rod is connected to the pivotable horn. This enables the rod to pivot laterally between open and closed positions away from and towards the watch case, respectively. After a watchband is threaded on the rod in the open position, the rod is rotated towards the closed position until the opposite end of the rod engages the opposed horn. A camming surface is provided between the rod and the opposed horn that causes the rod to be shortened against a spring force as it engages the opposed horn so that it can become aligned with a bore hole in the opposed horn and engage the borehole by the spring force extending the rod length. To release the rod from the opposed horn, a manual push piece is provided to enable manual shortening of the rod so that it clears the borehole and releases the rod for pivotal motion towards the open position.

18 Claims, 1 Drawing Sheet

FIG. 1
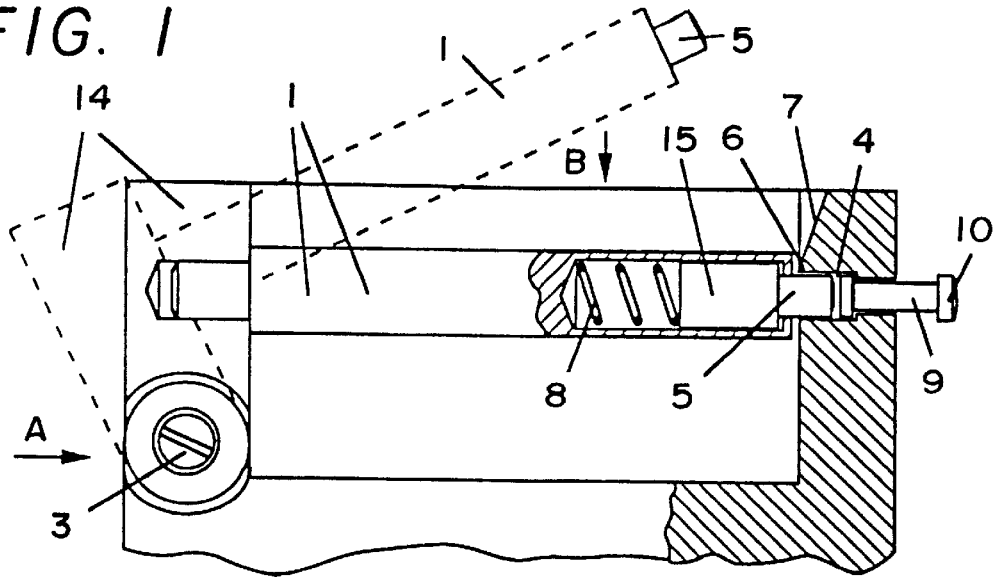
FIG. 2
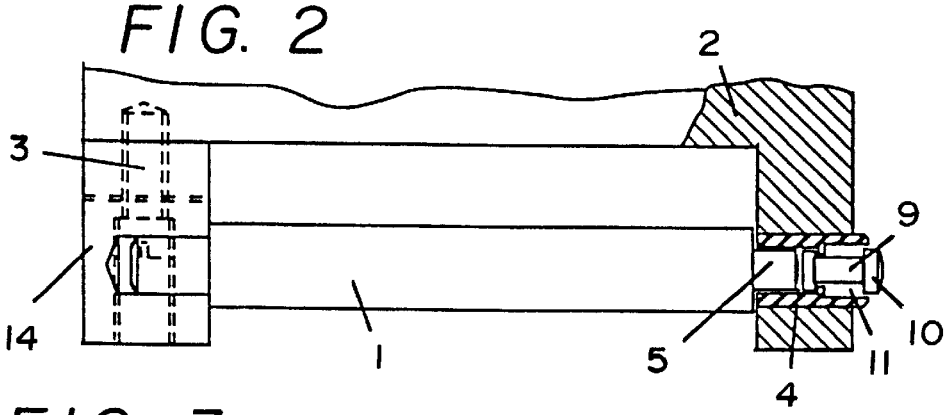
FIG. 3
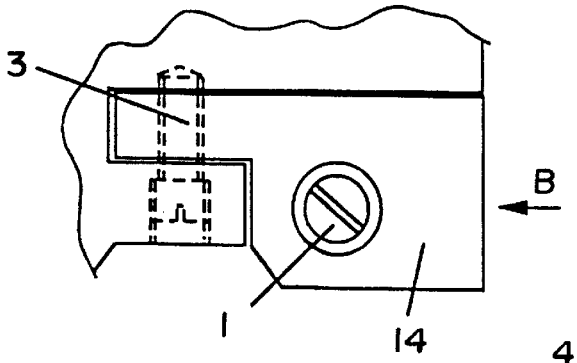
FIG. 4
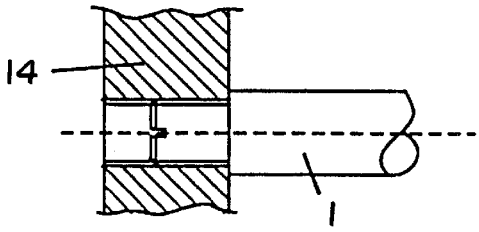
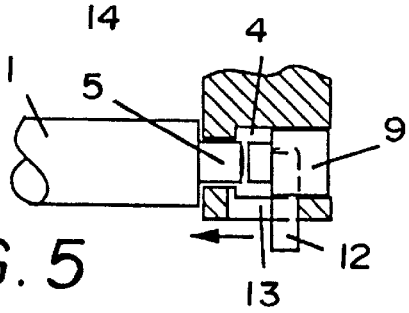
FIG. 5

DEVICE FOR DETACHABLY FIXING A WATCHBAND TO A WATCH CASE

BACKGROUND OF THE INVENTION

The current fashion requires the wearer of a watch, particularly if it is a woman, to match the watchband with her (or his) clothes. Various solutions have been developed and marketed to allow watchbands to be changed quickly.

The most common solutions involve the manufacture of a special watchband, which is often complicated; others allow conventional watchbands to be used but at the cost of a specially constructed watch case; still others require both. This invention belongs to the second category and therefore aims at providing a device for detachably fixing a watchband to a watch case, which allows the use of a conventional watchband.

In this category, German patent De 41 36 496A1 offers a device in which the holes provided in the horns of the watch case to contain the ends of the spring lugs to which the watchband is attached are open underneath. This allows the two ends of the spring lug to be easily introduced into their respective holes. To secure the spring lug in these holes, there is a pivoting plate which covers the lateral openings of the holes. To change the watchband, one only needs to pivot the plate in the other direction, and to extract laterally the spring lug solid with the watchband. The main inconvenience of this solution lies in the fact that the spring lug remains with the watchband, and could be lost if handled carelessly.

Patent CH 681 752, and patent FR 86 106 14 Vassort, propose a device in which the lug is rigidly attached to the watch case at one end, in such a way that only the watchband is removed during changing. A pivoting locking device makes it possible to lock the watchband at the other end of the spring lug. The locking device clicks into a notch on the end of the lug. Although such a device allows the use of conventional watchbands, it still has some inconveniences.

First of all, the notched locking system has the usual shortcoming of this sort of closures - it wears out quickly, even if the parts of the locking device which are subject to wear are made of steel, as suggested by patent CH 681 762. Moreover, the lug, held by one end only, is subject to strain, which can affect the strength of the closure. The closing device also has a protruding catch which can easily catch on something and open when the wearer makes any movement. Finally, the space which exists between the body of the watch case and the lug must necessarily be narrow, which makes the introduction of the watchband difficult, particularly if it is thicker than usual; and such variations in thickness are relatively frequent in watchbands made of leather, which is a natural material whose thickness is not necessarily standard.

Patent FR 92 098 71 shows a system in which the spring lug, also fixed by one end to the watch case, contains an obtuse angle. The part which penetrates the horn of the watch case constitutes one of the segments of the lug, and that which is outside, the other segment, each segment forming one side of the angle. the first segment is fixed in the horn in such a way as to allow it to pivot. As the second segment forms an angle with the pivot axis of the first segment, the free end of the lug makes a circular arc when pivoting. The hole in the other horn of the watch case for this free end is open laterally. As such, the lug only needs to be pivoted in order to pull it out of or put it back into its hole. A closing device allows the lug to be locked in the closed position once the free end is fitted in its hole. The main advantage of the system lies in the fact that it offers the user a greater space between the watch case body and the lug than the system contained in patent CH 681 762. However, it has the inconvenience of having an unusual construction and is therefore not easy to manage, i.e. fixing the lug in the watch case, to enable it to be rotated, is not easy, and the assembly hole must be bored on an angle.

BRIEF SUMMARY OF THE INVENTION

The invention presented here aims at providing a device for detachably fixing a watchband to a watch case, which avoids the above mentioned inconveniences.

More specifically, a device for securing a watchband to a pair of opposed watchband securing horns comprising part of a watch case includes a pivoting arrangement for pivotally securing one of the horns to the watch case for pivotal motion towards and away from the opposed horn and an arrangement for securing a watchband retaining rod to the pivoting horn. The rod is thus transversely pivotable towards and away from the watch case between open and closed positions.

The rod has spring biased sections so it is variable in length and is normally held extended by the spring element. When the rod is pivoted towards the opposed watch case horn, a cam surface causes the rod to shorten against the spring to enable the rod to align itself with a bore hole in the opposed horn for securing the rod to the watch case.

Thus, one need only pivot the rod towards the watch case to secure the rod completely between the watch case horns.

The camming surface for shortening the watchband rod may be provided on the rod itself or on a surface of the horn adjacent the bore hole that receives the rod.

A pushing element in the bore hole enables manual shortening of the watchband rod against the spring to permit it to clear the bore hole and pivot away from the watch case towards an open position.

BRIEF DESCRIPTION OF THE DRAWINGS

The diagrams represent, by way of example, one form of embodiment of the invention.

FIG. 1 is a bottom view of a part of the watch case fitted with the device contained in this invention with the watchband attaching rod in the closed position, and the dotted line representing the open position.

FIG. 2 is a view in direction B of FIG. 1, that is, a side view, of the part of the watch case represented in FIG. 1, but fitted with a version of a push-piece making it possible to free the watchband in which the head of the push-piece is almost flush with the external surface of the watch case.

FIG. 3 is a view in direction of arrow A of FIG. 1, that is a side view taken on a side of the watch case adjacent and perpendicular to the side at arrow B, and showing a variation in which may be seen the head of the rod, which is screwed in.

FIG. 4 is a partial side view showing the screwed assembly of the rod, as in the version represented in FIG. 3.

FIG. 5 is a sectional drawing of another version of a push-piece allowing the watchband to be freed, in which the push-piece is fitted with a catch protruding laterally.

DETAILED DESCRIPTION OF THE PREFERRED EMBODIMENT

The device according to the invention comprises at least one watchband securing rod 1 designed to receive the end of a watchband. This rod is fixed by its first end to the watch case 2 by way of a pivoting horn part 14 into which the rod is pushed, according to the version in FIGS. 1 and 2, or screwed, according to the version in FIGS. 3 and 4. The pivoting horn part 14 is itself fixed to the watch case by means of a pivot or pin 3 which here takes the form of a simple screw. The length of the rod is variable; the second end of the rod, the end opposite to the first end, has a cylindrical hollow at the bottom of which is set a helical spring 8. On the spring rests a cylinder 15, integral with another cylinder of a smaller diameter, which protrudes from the cylindrical hollow, and which forms the second end 5 of the rod. In the closed position, this second end is received into a bore hole 4 in the opposed horn of the watch case. The bore hole 4 has an entrance 6 forcing horn 14 for receiving end 5 of the rod 1. The bottom of the hole is closed by a push-piece 9. In the form of embodiment represented in FIG. 1, the head 10 of the push-piece extends beyond the watch case over a distance equal to the length of the course traversed by the other end of the rod until its complete retraction. In the version in FIG. 2, the head of the push piece is almost flush with the surface of the watch case. This configuration has the advantage of being discrete and avoids the risk of catching the push-pin. However, it requires the use of a pointed object, for example, a ball-point pen, to press in the push-pin. In the version represented in FIG. 5, the push-pin 9 is fitted with lateral catch 12; a longitudinal opening 13, parallel to the axis of the push-piece, is arranged in the wall of the passage and allows the catch to protrude on the outside in such a way as to afford a hold for the user's finger. This solution also offers the advantage of discretion and may be preferred in certain cases for primarily aesthetic reasons. The horn in which the hole 4 extends, contains a slanting surface 7 between the end of the horn away from the watch case and the entrance 6 of the hole, situated at the point of contact between the horn and the second end 5 of the rod when the rod is pivoted towards a closing position. When the rod is in the open position, as depicted by the dotted line in FIG. 1, the user threads the watchband on to the rod 1, and then pushes back the rod towards the watch case. The rod pivots around the pin 3, which is perpendicular to the plane in which the rod moves. The end 5 of the rod touches the slanting surfaces 7. The pivoting movement continues, the end 5 slides along the slanting surface 7, and, as the distance narrows, the rod shortens, compressing the spring 8. Having aligned with entrance 6, the spring 8 releases and the end 5 inserts into the hole 4.

Taking off the watchband is performed in the opposite manner, by pushing in the end 5 by means of the push-piece and by pulling on the rod in such a way as to make it pivot in the other direction.

In a form of embodiment not represented here, the slanting surface 7 is arranged at the tip of the end 5. It is also possible to provide such slanting surfaces equally well on the edge of entrance 6 as on the tip of the end 5.

In the form of embodiment represented in FIGS. 3 and 4, the rod traverses the pivoting connecting horn part 14, and its end, now visible through the opening in the horn on the opposite side, contains a slot for the use of a screwdriver, which facilitates the assembly of the rod to the pivoted horn. Of course, the slot may take a different form where appropriate, such as a cross-shape.

We claim:

1. A device for securing a watchband to a watch case, said device comprising:

a pair of opposed watchband securing horns on a watch case, one of said horns pivotally connected to the watch case for pivotal motion towards and away from the opposed horn about a pivot axis extending transversely of the watch case, and including a first connector for a watchband securing rod;

a watchband securing rod having a length and first and second ends, the first end secured to the one horn by the first connector for pivotal motion of the rod with the one horn in a direction transversely of the length of the rod towards and away from the watch case and the opposed horn;

one end of said rod being moveable lengthwise of the rod for varying the rod length, said rod at its full length being longer than the distance between the opposed horns when the one horn is pivoted to its closest position relative to the other horn;

an elastic element normally biasing the moveable end of the rod towards a full length position but yieldable elastically for permitting the length of the rod to decrease;

the opposed horn including a bore hole for receiving the second end of the rod opposite the first end attached to the pivoted horn, said bore hole defining a rod end receiving entrance for receiving the second end of the rod when the rod is to be secured to the opposed horn, said entrance located a distance inwardly from an end of the horn facing away from the watch case and facing towards the pivoted horn;

a rod camming surface located on the opposed horn between said rod end receiving entrance and the end of the horn facing away from the watch case and arranged to engage the second end of the rod at its full length as the rod is pivoted towards the rod end receiving entrance and to cause the rod to decrease in length against the bias of said elastic element by causing relative motion between said moveable end and the rod while the second end of the rod traverses the camming surface at least until the second end intersects the rod receiving entrance, whereupon the rod may expand to full length under the influence of the elastic element with the second end located in said bore hole.

2. The device according to claim 1, including a manually moveable rod pusher in the bore hole moveable towards and away from the second rod end so that the rod and its moveable end may be moved relative to each other against the bias of said elastic element to vary the rod length, said pusher being manually moveable to enable the rod length to be decreased sufficiently to enable the rod second end to clear the rod end receiving entrance and the rod to be pivoted transversely of the rod length away from said opposed horn.

3. The device according to claim 2, including a pusher receiving passage in said bore hole, said pusher disposed in said passage; said pusher having a head portion that is enlarged relative to another portion of the pusher in the passage; at least a portion of said passage having a size sufficient to receive the enlarged head portion.

4. The device according to claim 2, including an elongated transverse opening in communication with and extending parallel with said bore hole; said pusher including a manipulating catch extending through said transverse opening; the length of said opening permitting sufficient travel of said catch to manipulate the pusher over its full operating range.

5. The device according to claim 1, wherein the one pivoted horn includes a rod receiving threaded aperture traversing the one horn, and the first end of said rod extending through said aperture in threaded engagement therewith.

6. The device according to claim 5, wherein said first end of said rod includes a slotted head for receiving a screwdriver blade via said aperture.

7. The device according to claim 6, wherein said one horn is pivotally attached to the watch case by a pivot pin defining a pivot axis of the one horn, said pivot pin extending perpendicular to the plane of pivotal motion of said one horn.

8. The device according to claim 1, wherein said one horn is pivotally attached to the watch case by a pivot pin defining a pivot axis of the one horn, said pivot pin extending perpendicular to the plane of pivotal motion of said one horn.

9. The device according to claim 8, said pivot pin comprising a removable fastener for permitting selective release of the one horn from the watch case.

10. A device for securing a watchband to a watch case, said device comprising:

a pair of opposed watchband securing horns on a watch case, one of said horns pivotally connected to the watch case for pivotal motion towards and away from the opposed horn about a pivot axis extending transversely of the watch case, and including a first connector for a watchband securing rod;

a watchband securing rod having a length and first and second ends, the first end secured to the one horn by the first connection for pivotal motion of the rod with the one horn in a direction transversely of the length of the rod towards and away from the watch case and the opposed horn;

one end of said rod being moveable lengthwise of the rod for varying the rod length, said rod at its full length being longer than the distance between the opposed horns when the one horn is pivoted to its closet position relative to the other horn;

an elastic element normally biasing the moveable end of the rod towards a full length position but yieldable elastically for permitting the length of the rod to decrease;

the opposed horn including a bore hole for receiving the second end of the rod opposite the end attached to the pivoted horn, said hole defining a rod end receiving entrance for receiving the second end of the rod when the rod is to be secured to the opposed horn, said entrance located a distance inwardly from an end of the horn facing away from the watch case and facing towards the pivoted horns;

a rod camming surface located on the second end of the rod and arranged to engage the opposed horn when the rod is at its full length as the rod is pivoted towards the rod end receiving entrance and to cause the rod to decrease in length against the bias of said elastic element by causing relative motion between said moveable end and the rod while the camming surface engages the opposed horn at least until the second rod end intersects the rod receiving entrance, whereupon the rod may expand to full length under the influence of the elastic element with the second end located in said bore hole.

11. The device according to claim 10, including a manually moveable rod pusher in the bore hole moveable towards and away from the second rod end so that the rod and its moveable end may be moved relative to each other against the bias of said elastic element to vary the rod length, said pusher being manually moveable to enable the rod length to be decreased sufficiently to enable the rod second end to clear the rod end receiving entrance and the rod to be pivoted transversely of the rod length away from said opposed horn.

12. The device according to claim 11, including a pusher receiving passage in said bore hole, said pusher disposed in said passage; said pusher having a head portion that is enlarged relative to another portion of the pusher in the passage; at least a portion of said passage having a size sufficient to receive the enlarged head portion.

13. The device according to claim 11, including an elongated transverse opening in communication with and extending parallel with said bore hole; said pusher including a manipulating catch extending through said transverse opening; the length of said opening permitting sufficient travel of said catch to manipulate the pusher over its full operating range.

14. The device according to claim 10, wherein the one pivoted horn includes a rod receiving threaded aperture traversing the one horn, and the first end of said rod extends through said aperture in threaded engagement therewith.

15. The device according to claim 14, wherein said first end of said rod includes a slotted head for receiving a screwdriver blade in said aperture.

16. The device according to claim 15, wherein said one horn is pivotally attached to the watch case by a pivot pin defining a pivot axis of the one horn, said pivot pin extending perpendicular to the plane of pivotal motion of said one horn.

17. The device according to claim 10, wherein said one horn is pivotally attached to the watch case by a pivot pin defining a pivot axis of the one horn, said pivot pin extending perpendicular to the plane of pivotal motion of said one horn.

18. The device according to claim 17, said pivot pin comprising a removable fastener for permitting selective release of the one horn from the watch case.

* * * * *